US005642775A

United States Patent [19]

Akachi

[11] Patent Number: 5,642,775

[45] Date of Patent: Jul. 1, 1997

[54] RIBBON-LIKE PLATE HEAT PIPES

[75] Inventor: Hisateru Akachi, Sagamihara, Japan

[73] Assignees: Actronics Kabushiki Kaisha, Isehara; Hisetaru Akachi, Sagamihara, both of Japan

[21] Appl. No.: 602,310

[22] Filed: Feb. 16, 1996

[30] Foreign Application Priority Data

Feb. 16, 1995 [JP] Japan ..... 7-065311

[51] Int. Cl.[6] ..... F28D 15/00

[52] U.S. Cl. ..... 165/104.14; 165/170; 165/168; 165/104.21; 165/104.19

[58] Field of Search ..... 165/168, 170, 165/104.26, 104.21, 104.19, 104.14

[56] References Cited

U.S. PATENT DOCUMENTS

| | | | |
|---|---|---|---|
| 1,828,477 | 10/1931 | Seligman | 165/170 |
| 1,961,660 | 6/1934 | Fehrmann | 165/170 |
| 3,387,653 | 6/1968 | Coe | 165/170 |
| 4,150,720 | 4/1979 | Brackman | 165/170 |
| 4,921,041 | 5/1990 | Akachi | 165/104.29 |
| 5,076,351 | 12/1991 | Munekawa et al. | 165/104.14 X |
| 5,179,500 | 1/1993 | Koubek et al. | 165/104.14 X |
| 5,219,020 | 6/1993 | Akachi | 165/104.26 |
| 5,351,746 | 10/1994 | Mackey et al. | 165/104.14 X |

FOREIGN PATENT DOCUMENTS

| | | | |
|---|---|---|---|
| 0025735 | 3/1981 | European Pat. Off. | 165/168 |
| 1768915 | 10/1992 | U.S.S.R. | 165/168 |

*Primary Examiner*—John Rivell
*Assistant Examiner*—Christopher Atkinson
*Attorney, Agent, or Firm*—Foley & Lardner

[57] ABSTRACT

A ribbon-like plate heat pipe comprises a ribbon-like plate having tunnels arranged parallel to each other and defined by partitions. The ribbon-like plate has both ends closed such that the tunnels are filled with melt metal up to a predetermined depth from each end of the ribbon-like plate upon welding or soldering. The partitions are alternately eliminated by a predetermined length in the vicinity of the ends of the ribbon-like plate so as to ensure communication of the tunnels with each other to form a serpentine container having a predetermined turns. The serpentine container is filled with a predetermined amount of working fluid.

26 Claims, 8 Drawing Sheets

RIBBON-LIKE PLATE HEAT PIPES

BACKGROUND OF THE INVENTION

The present invention relates generally to a ribbon-like plate heat pipe and more particularly, to a ribbon-like plate heat pipe having a looped serpentine capillary tunnel container formed therein.

Various plate heat pipes having a capillary tube interposed between metallic plates have been developed for purposes of heat diffusion and transport. Such plate heat pipes have an extremely decreased thickness and weight due to application of, e.g. U.S. Pat. No. 4,921,041 to Akachi, and U.S. Pat. No. 5,219,020 to Akachi. However, with a quick progress of a reduction in size and weight of semiconductor devices as exothermic elements, there is an increasing demand for a further reduction in thickness and weight of the plate heat pipes.

In response to such demand, a tunnel-plate type heat pipe is proposed as disclosed in U.S. patent application Ser. No. 08/352,217 filed Dec. 2, 1994. This tunnel-plate type heat pipe comprises a first metallic plate having one side formed with a groove which forms a continuous channel therein, and has a predetermined number of turnings and a predetermined number of portions arranged in parallel with each other, and a second metallic plate disposed on one side of the first plate wherein the second plate closes the channel such that the groove of the first plate serves as a tunnel to be charged with a predetermined amount of working fluid. With this structure, the inner diameter of the tunnel can be 0.3 mm, resulting in a reduced thickness of the plate heat pipe up to 0.5 mm or less.

When forming the tunnel-plate type heat pipe, the metallic plates are joined according to a hard solder joining method and a diffusion joining method, which need not only a large-sized vacuum furnace, but a furnace face machining jig or press working machine for face joining in the furnace. This results in a restricted maximum size and area of the heat pipe, which corresponds to approximately 1 m×1 m for a plate-like heat pipe, and 100 mm×2 m for a ribbon-like heat pipe. Moreover, the size of an NC milling machine for machining a groove in one side of the metallic plate, various devices for photo-etching of a groove pattern, etc. operates to prevent an increase in size and area of the heat pipe.

It is, therefore, an object of the present invention to provide a ribbon-like plate heat pipe which has a largely increased size and area.

SUMMARY OF THE INVENTION

According to one aspect of the present invention, there is provided a ribbon-like plate heat pipe, comprising:

a plate having a plurality of tunnels arranged parallel to each other and defined by a plurality of partitions;

means for closing ends of said plate, said ends closing means being disposed up to a predetermined depth of said plurality of tunnels from each end of said plate; and means for ensuring communication of said plurality of tunnels with each other to form a serpentine container having a predetermined turns, said serpentine container being filled with a predetermined amount of a predetermined working fluid.

Another aspect of the present invention lies in providing a ribbon-like plate heat pipe equipment, comprising:

a plurality of ribbon-like plate heat pipes disposed parallel to each other, each comprising a plate having a plurality of tunnels arranged parallel to each other and defined by a plurality of partitions; means for closing ends of said plate, said ends closing means being disposed up to a predetermined depth of said plurality of tunnels from each end of said plate; and means for ensuring communication of said plurality of tunnels with each other to form a serpentine container having a predetermined turns, said serpentine container being filled with a predetermined amount of a predetermined working fluid; and means for connecting said plurality of ribbon-like plate heat pipes to each other.

Still another aspect of the present invention lies in providing a ribbon-like plate heat pipe equipment, comprising:

a flat plate;

a plurality of ribbon-like plate heat pipes disposed on said flat plate at predetermined intervals to be parallel to each other, each comprising a plate having a plurality of tunnels arranged parallel to each other and defined by a plurality of partitions; means for closing ends of said plate, said ends closing means being disposed up to a predetermined depth of said plurality of tunnels from each end of said plate; and means for ensuring communication of said plurality of tunnels with each other to form a serpentine container having a predetermined turns, said serpentine container being filled with a predetermined amount of a predetermined working fluid; and means for ensuring communication of said serpentine container of one of said plurality of ribbon-like plate heat pipes with that of an adjacent one thereof, said communication ensuring means enabling formation of a continuous serpentine container having a predetermined turns through said plurality of ribbon-like plate heat pipes.

The other aspect of the present invention lies in providing a ribbon-like plate heat pipe equipment, comprising:

a plurality of plates disposed in series to form a plate assembly, each having a plurality of tunnels arranged parallel to each other and defined by a plurality of partitions;

means for connecting said plurality of tunnels of one of said plurality of plates and those of an adjacent one thereof;

means for closing ends of said plate assembly, said ends closing means being disposed up to a predetermined depth of said plurality of tunnels from each end of said plate assembly.

DETAILED DESCRIPTION OF THE INVENTION

Figure 1:
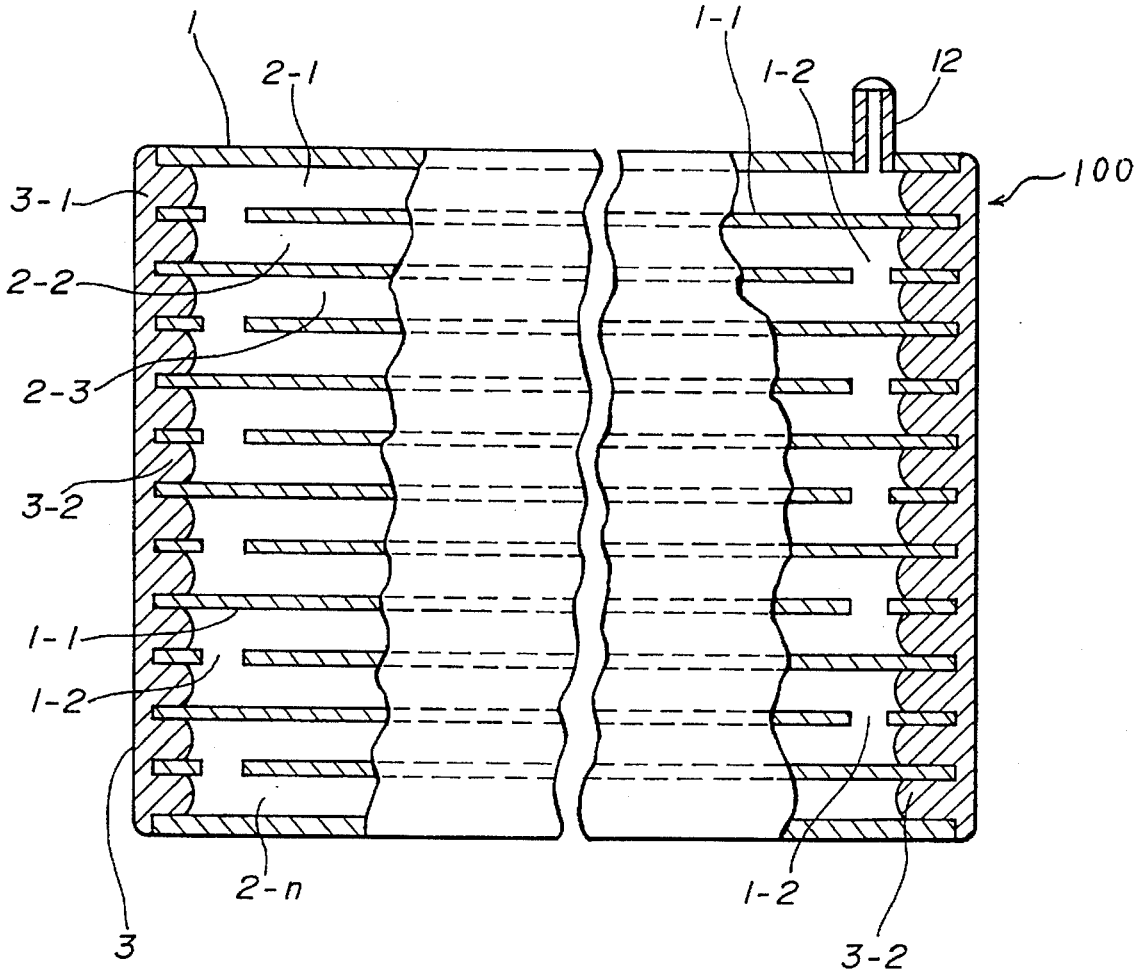
FIG. 1 is a plan view, partly broken, showing a ribbon-like plate heat pipe according to the present invention.

Referring to the drawings wherein like reference numerals designate like parts throughout the views, a description will be made with regard to preferred embodiments of a ribbon-like plate heat pipe according to the present invention.

A recent progress in the art of metal extrusion molding enables an extrusion molding of a ribbon-like plate having a plurality of capillary parallel tunnels. Particularly, the art of extrusion molding of a soft metal such as pure aluminum, aluminum alloy, or magnesium alloy is remarkably developed to make successfully a plate with a thickness of 2 mm or less and several tens of capillary tunnels of approximately 1 mm inner diameter. Due to extrusion molding of the soft metal, a plate with a length of several tens meters is easily obtained at present, the length being estimated to be several hundreds meters in the future.

Referring to FIG. 1, a ribbon-like plate heat pipe 100 according to the present invention is formed in accordance with the above extrusion molding of the soft metal, and comprises a metallic ribbon-like plate 1 having a plurality of capillary parallel tunnels 2-1, 2-2, 2-3 . . . 2-n defined by a plurality of partitions 1-1. The ribbon-like plate 1 has both ends closed by closing means 3. The capillary parallel tunnels 2-1, 2-2, 2-3 . . . 2-n are communicated with each other by communicating means arranged in the vicinity of the ends of the ribbon-like plate 1. The communicating means may be such that the partitions 1-1 are alternately eliminated by a predetermined length in the vicinity of the ends of the ribbon-like plate 1. Thus, the capillary parallel tunnels form a continuous serpentine capillary tunnel container for working fluid of the heat pipe.

Figure 3:
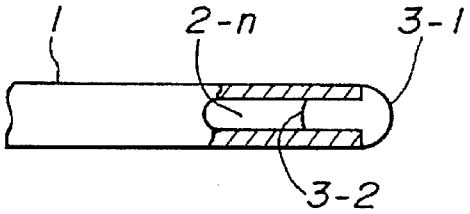
FIG. 3 is a fragmentary side view, partly in section, showing a structural example of an end of the ribbon-like plate heat pipe.
Figure 4:
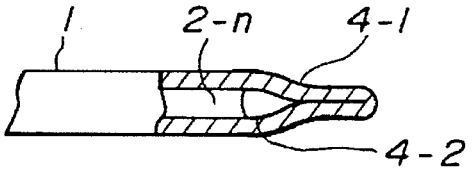
FIG. 4 is a view similar to FIG. 3, showing another structural example of the end of the ribbon-like plate heat pipe.
Figure 5:
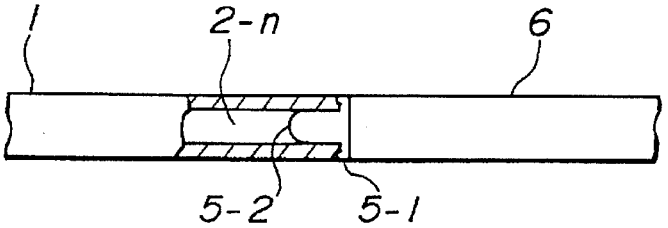
FIG. 5 is a view similar to FIG. 4, showing the other structural example of the end of the ribbon-like plate heat pipe.

The capillary parallel tunnels 2-1, 2-2, 2-3 . . . 2-n are completely filled with the closing means 3 up to a predetermined depth from each end of the ribbon-like plate 1 as shown in FIG. 1. The closing means 3 can be obtained by face-fed welding as shown in FIG. 3, squeezing & welding as shown in FIG. 4, or butt welding as shown in FIG. 5. Specifically, referring to FIG. 3, according to face-fed welding, the closing means 3 include a face-fed welded portion 3-1 and a solder filling portion 3-2. Referring to FIG. 4, according to squeezing & welding, the closing means 3 include a squeezed welded portion 4-1 and a solder filling portion 4-2. Referring to FIG. 5, according to butt welding, a metallic ribbon-like plate 6 with no capillary parallel tunnels or a small piece thereof is butted and welded to the metallic ribbon-like plate 1 with capillary parallel tunnels 2-1, 2-2, 2-3 . . . 2-n, so that the closing means 3 include the ribbon-like plate 6, a butt welded portion 5-1, and a solder filling portion 5-2.

With each welding, a sufficient amount of a melt metal is produced upon welding operation to penetrate into the capillary parallel tunnels 2-1, 2-2, 2-3 . . . 2-n up to a predetermined depth from each end of the ribbon-like plate 1. Due to the closing means 3 obtained in such a way, an end portion of the ribbon-like plate 1 forms an integrated metal block having a strong structure, which contributes to an improvement of the mechanical strength and reliability of the ribbon-like plate heat pipe 100 of which a severe handling cannot avoid in some cases. Moreover, with respect to an internal pressure due to high pressure vapor which can be produced by a temperature rise of working fluid or use of working fluid having high saturated vapor pressure, an end portion of the ribbon-like plate heat pipe 100, the weakest portion, is hermetically ensured by arrangement of the closing means 3, resulting in improved reliability for a pressure proof performance.

Figure 8:
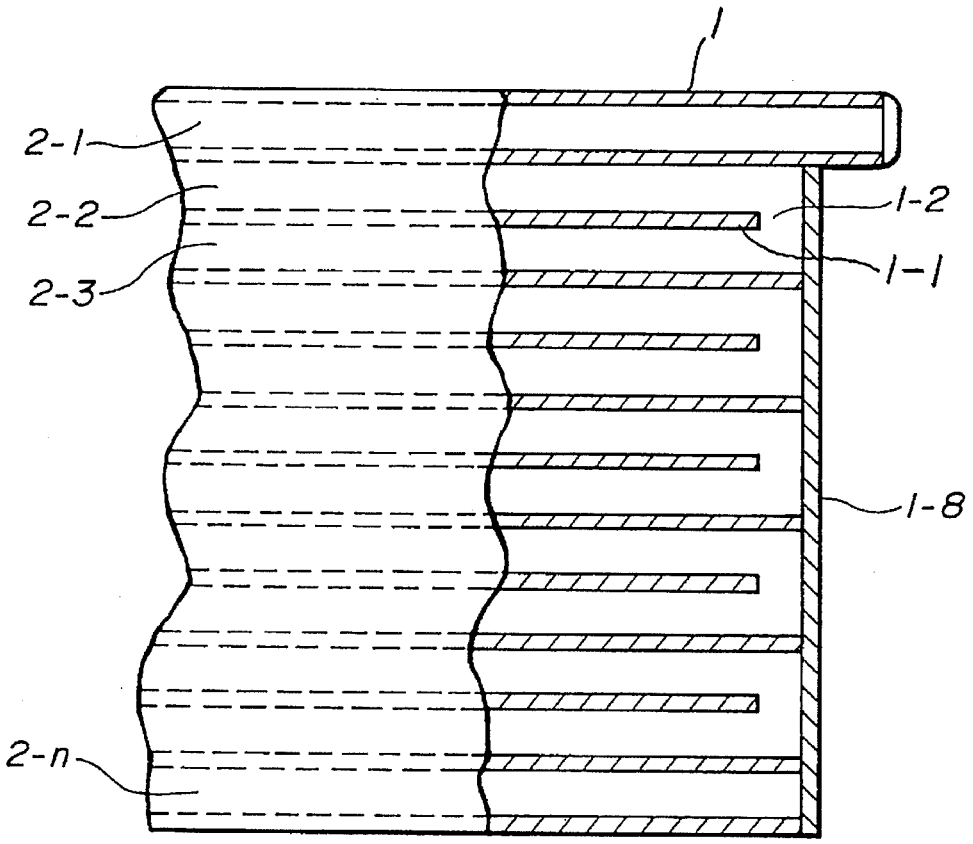
FIG. 8 is a view similar to FIG. 6, showing a structural example of an end of a known ribbon-like plate heat pipe.

Referring to FIG. 8, there is shown an example of the closing means 3 of the ends of the ribbon-like plate 1, which is not included in the present invention. Specifically, the partition 1-1 is partly eliminated from the side of the end of the ribbon-like plate 1 or a pointed end of the partition 1-1 so as to obtain a partition eliminated portion 1-2. Then, a metallic ribbon 1-8 is welded to the end of the ribbon-like plate 1 to close the capillary parallel tunnels 2-1, 2-2, 2-3 . . . 2-n. In that case, a produced amount of a melt metal should be restrained to prevent the melt metal from closing the partition eliminated portion 1-2. Moreover, the number of the partitions 1-1 welded to the metallic ribbon 1-8 is half reduced, so that a welded area of the partitions 1-1 is extremely decreased with respect to the metallic ribbon 1-8, lowering the mechanical strength of the end portion of the heat pipe, resulting in extremely deteriorated reliability thereof.

Figure 2:
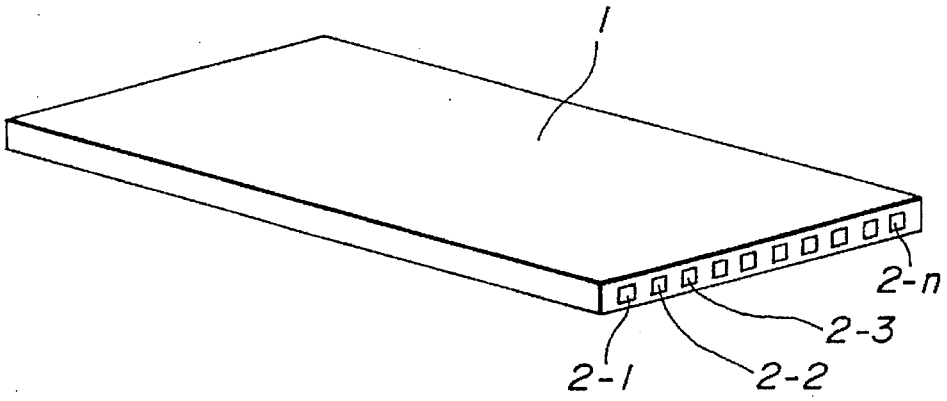
FIG. 2 is a perspective view showing a ribbon-like plate having a plurality of capillary parallel tunnels.

Returning to FIGS. 1 and 2, as described above, according to the present invention, the communicating means for ensuring communication of the capillary parallel tunnels 2-1, 2-2, 2-3 . . . 2-n with each other is such that the partitions 1-1 are alternately eliminated by a predetermined length in the vicinity of the ends of the ribbon-like plate 1. Elimination of the partitions 1-1 can be carried out by various methods. The simplest method is a perforation from a surface of the ribbon-like plate 1 in the vicinity of the ends thereof, openings produced by perforation being then closed by welding. Though simple, this method needs means for ensuring a perforating position in view of invisibility of the partitions 1-1.

The structure of the end portions and communicating means of the ribbon-like plate heat pipe 100 does not always need soldering in the vacuum or atmosphere furnace, and can be obtained by known AC TIG welding, argon arc welding or soldering, etc. Moreover, the conventional plate heat pipe is such that a hermetic capillary tunnel container is obtained by joining of the metallic plates, while the ribbon-like plate 1 has capillary parallel tunnels 2-1, 2-2, 2-3 . . . 2-n as previously formed, so that joining of the ribbon-like plate heat pipes 100 can be ensured by hard or soft soldering in the ordinary atmosphere without deteriorating airtightness of the capillary parallel tunnels.

Thus, according to the present invention, since there is no restriction of the length, nor need of furnace soldering for forming of the end portions and joining with another ribbon-like plate heat pipe, a larger or longer ribbon-like plate heat pipe can be obtained, having, e.g. 6 m×1 m in size, or 50 m in length. Moreover, by grace of a recent progress in the art of metal extrusion molding, a thinner ribbon-like plate heat pipe can be formed, having, e.g. 1.5 mm in thickness with 0.8 mm in tunnel inner diameter.

Figure 6:
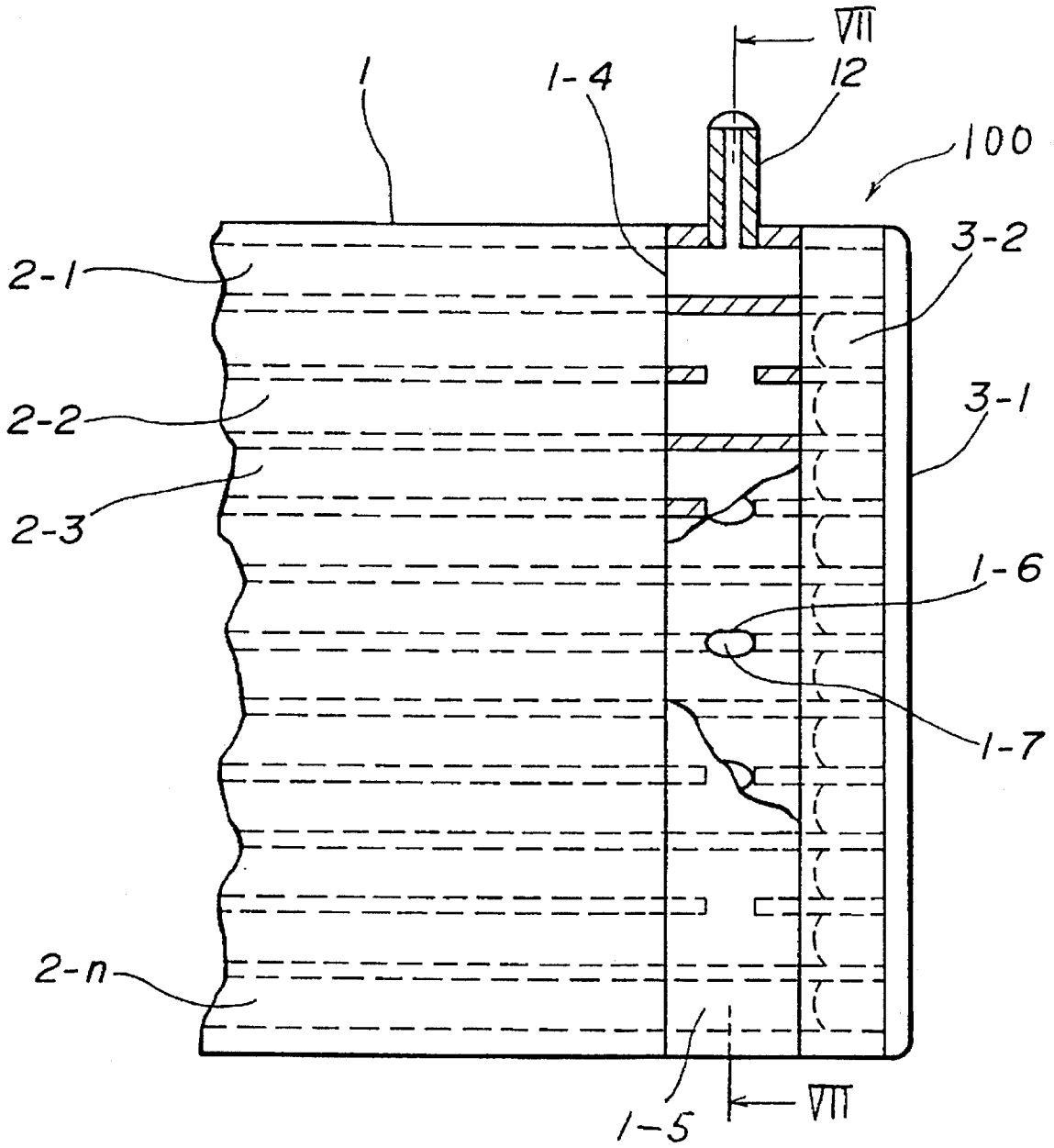
FIG. 6 is a fragmentary plan view, partly broken, showing a first preferred embodiment of the ribbon-like plate heat pipe.
Figure 7:
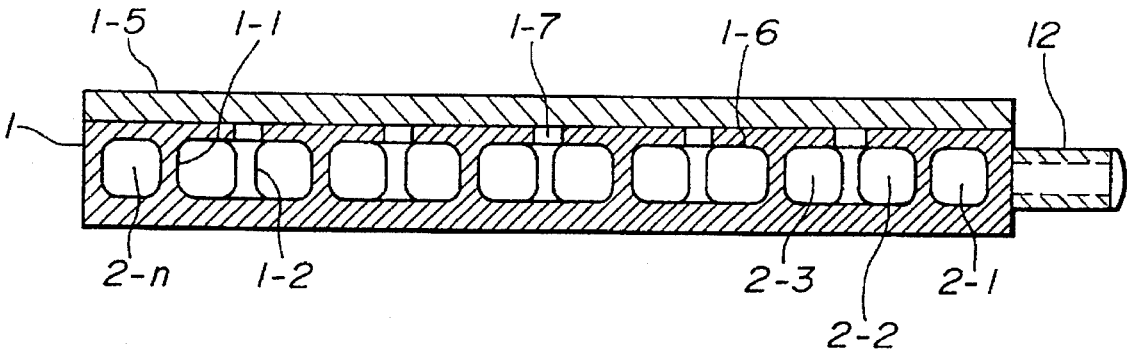
FIG. 7 is a cross section taken along the line VII—VII in FIG. 6.

Referring next to FIGS. 6 and 7, a first embodiment of the present invention will be described. The first embodiment is conceived to eliminate easily and surely the partitions 1-1 formed in the metallic ribbon-like plate 1. Referring to FIG. 6, first, a groove 1-4 is formed in a surface of the metallic ribbon-like plate 1 in a position at a predetermined distance away from the end thereof so as to be substantially perpendicular to longitudinal edges of the ribbon-like plate 1. Referring also to FIG. 7, the groove 1-4 is not deep enough to reach a film 1-6 disposed on a top wall of the capillary parallel tunnel, whereas the film 1-6 is thin enough to enable confirmation of a position of the partitions 1-1 by finger touching and/or visually. The width of the groove 1-4 is sufficiently greater than the length of the partition eliminated portion 1-2. Then, the partition eliminated portion 1-2 is formed by removing a part of the film 1-6 through a bottom of the groove 1-4, and making a hole 1-7 up to a bottom wall of the capillary parallel tunnel so as to eliminate a predetermined portion of the partition 1-1. A metallic tape 1-5 having corresponding width and thickness is fitted into and welded to the groove 1-4, by which the hole 1-7 is closed hermetically, obtaining the continuous serpentine capillary tunnel container.

In the first embodiment, the film 1-6 has an important function of increasing largely a welded area of the groove 1-4 with the metallic tape 1-5, resulting in improved reliability of hermetic sealing ensured by the metallic tape 1-5. Moreover, the film 1-6 enables sure finger touching and/or visual confirmation of a position of the partitions 1-1, resulting in easy eliminating work thereof.

Figure 9:
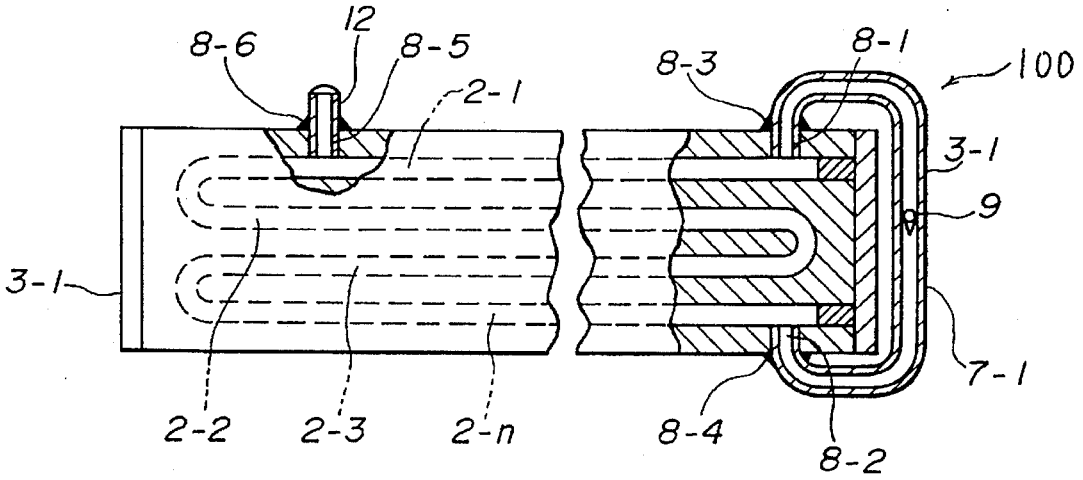
FIG. 9 is a view similar to FIG. 1, showing second and third preferred embodiments of the present invention.

Referring to FIG. 9, a second embodiment of the present invention will be described. According to the first embodiment, a ribbon-like plate heat pipe having a non-looped serpentine capillary tunnel can be obtained, which is, however, a simple application of a micro-heat pipe as disclosed, e.g. in U.S. Pat. No. 5,219,020 which is incorporated herein for reference. The second embodiment is conceived to obtain a ribbon-like plate heat pipe having a looped serpentine capillary tunnel which is an application of a looped heat pipe as disclosed, e.g. in U.S. Pat. No. 4,921,041 which is incorporated herein for reference.

Referring to FIG. 9, the ribbon-like plate 1 having capillary parallel tunnels 2-1, 2-2, 2-3 . . . 2-n is made of a metallic material with a fusing point sufficiently lower than that of pure copper. Two through holes 8-1, 8-2 are formed through longitudinal edge walls of the ribbon-like plate heat pipe 100 to correspond to both ends of the continuous serpentine capillary tunnel container, and reach the capillary parallel tunnels 2-1, 2-n. A capillary connecting tube 7-1 with a predetermined length is arranged to have both ends inserted into the through holes 8-1, 8-2, and is welded or soldered hermetically (8-3, 8-4). The connecting tube 7-1 is made of a pure copper tube coated with the same metallic material as that of the ribbon-like plate 1. The material for defining the through holes 8-1, 8-2 and that of the connecting tube 7-1 are identical, so that soldering welding of the two ensures joining with high reliability. Moreover, in view of the fact that as being arranged outside, the connecting tube 7-1 is apt to undergo a damage and/or bending due to an external force, it is made of pure copper which is the most resistant of metals in terms of an external force, obtaining the most appropriate connecting tube.

In such a way, the continuous serpentine capillary tunnel container is formed like a loop, obtaining a looped serpentine capillary tunnel container which is an application of U.S. Pat. No. 5,219,020. A check valve 9 may be arranged in the connecting tube 7-1 for ensuring communication between the ends of the continuous serpentine capillary tunnel container, which is an application of U.S. Pat. No. 4,921,041.

Referring always to FIG. 9, a third embodiment of the present invention will be described. The third embodiment shows a structure of a capillary tube for injecting working fluid in the ribbon-like plate heat pipe of the present invention. Referring to FIG. 9, the ribbon-like plate 1 having capillary parallel tunnels 2-1, 2-2, 2-3 . . . 2-n is made of a metallic material with a fusing point sufficiently lower than that of pure copper. A through holes 8-5 is formed through the longitudinal edge wall of the ribbon-like plate heat pipe 100 to reach the capillary parallel tunnel 2-1. A working fluid injecting tube 12 with a predetermined length is arranged to have one end inserted into the through hole 8-5, and is welded or soldered hermetically (8-6). The working fluid injecting tube 12 is made of a pure copper tube coated with the same metallic material as that of the ribbon-like plate 1. The other end of the working fluid injecting tube 12 is protruded from the ribbon-like plate heat pipe 100. The material for defining the through hole 8-5 and that of the working fluid injecting tube 12 are identical, so that welding or soldering of the two ensures joining with high reliability. It is noted that this welding or soldering can be made without any possibility of closing the parallel tunnel 2-1.

Both ends of the continuous serpentine capillary tunnel container undergo the greatest vapor pressure of working fluid within the ribbon-like plate heat pipe 100. The working fluid injecting tube 12 needs to resist this high internal pressure not only upon injection of working fluid, but during operation of the ribbon-like plate heat pipe 100. Since the pure copper tube is such that internal walls are effectively press contacted by caulking or squeezing, which produces a great joining force, it is the most appropriate material of the working fluid injecting tube 12. Further, due to its excellent flexibility, the pure copper tube is hardly cracked or broken upon caulking and squeezing. Furthermore, when the working fluid injecting tube is arranged outside as in the third embodiment, it is preferable to use the pure copper tube which is excellent in flexibility, and is hardly cracked or broken by an external force.

Figure 10:
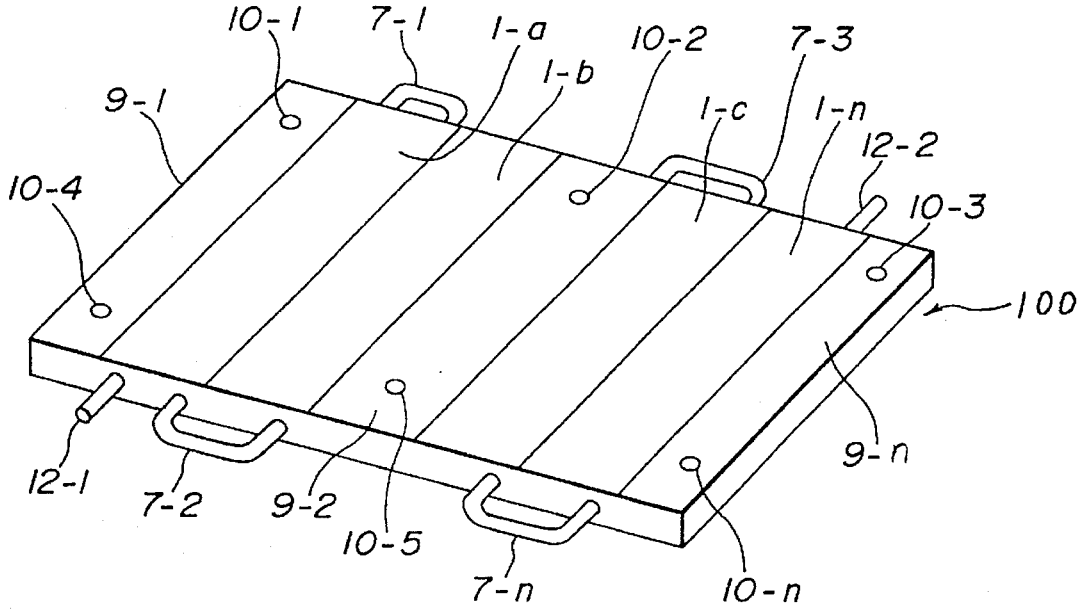
FIG. 10 is a view similar to FIG. 2, showing a fourth preferred embodiment of the present invention.

Referring to FIG. 10, a fourth embodiment of the present invention will be described. The fourth embodiment is conceived to mass-produce a wide ribbon-like plate heat pipe easily and economically. Referring to FIG. 10, the ribbon-like plate heat pipe 100 comprises a plurality of ribbon-like plate heat pipe units 1-a, 1-b, 1-c . . . 1-n connected parallel to each other. Alternatively, the ribbon-like plate heat pipe 100 may comprise a plurality of ribbon-like plate heat pipe units 1-a, 1-b, 1-c . . . 1-n and a plurality of metallic ribbon-like plates 9-1, 9-2 . . . 9-n with no continuous serpentine capillary tunnel container, but with ribbon-like plate heat pipe mounting means in the form of holes 10-1, 10-2, 10-3 . . . 10-n, the ribbon-like plate heat pipe units and the ribbon-like plates being disposed alternately, and connected parallel to each other. The continuous serpentine capillary tunnel containers of the ribbon-like plate heat pipe units 1-a, 1-b, 1-c . . . 1-n may not be connected to each other, each container having at least 20 or more turns. Alternatively, the continuous serpentine capillary tunnel containers may be connected to each other by connecting means in the form of the capillary connecting tubes 7-1, 7-2, 7-3 . . . 7-n in the similar way as described in connection with the third embodiment, the continuous serpentine capillary tunnel containers having at least 20 or more turns in their entirety.

An experience teaches that for allowing a serpentine capillary heat pipe to fully give its characteristic irrespective of a holding position, one serpentine capillary container has, preferably, at least 20 or more turns. This is true for the plate heat pipe having a continuous serpentine capillary tunnel container. Specifically, the characteristic irrespective of a holding position results from arrangement of a plurality of heat receiving portions in one serpentine capillary tunnel container, and mutual amplification of pressure waves due to nuclear boiling produced simultaneously in the heat receiving portions. The mutual amplification occurs effectively with 20 or more heat receiving portions, i.e. 20 or more turns. An experience reveals that with 80 or more turns, an ordinary plate heat pipe has no difference in performance between a bottom heat mode and a top heat mode.

Generally, for mass-producing a wide ribbon-like plate heat pipe of the present invention, it is necessary to assemble the metallic ribbon-like plates 1 which are kept as stocks. This is not expedient economically. On the other hand, according to the fourth embodiment, a wide ribbon-like plate heat pipe can be mass-produced easily and economically. It is noted that in place of the capillary connecting tubes 7-1, 7-2, 7-3 . . . 7-n, the connecting means may be tunnels arranged between adjacent ribbon-like plate heat pipes.

The ribbon-like plate heat pipe 100 often needs mounting means upon application. The structure of the fourth embodiment having the metallic ribbon-like plates 9-1, 9-2 . . . 9-n with the mounting holes 10-1, 10-2, 10-3 . . . 10-n is effective in such circumstances. In FIG. 10, reference numerals 12-1, 12-2 designates working fluid injecting tubes, respectively.

Figure 11:
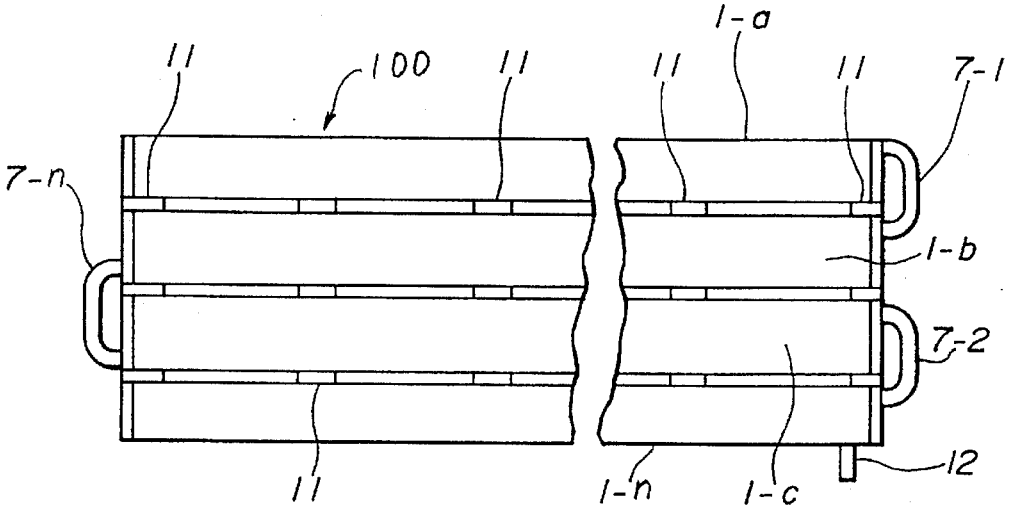
FIG. 11 is a plan view showing a fifth preferred embodiment of the present invention.

Referring to FIG. 11, a fifth embodiment of the present invention will be described. The fifth embodiment shows an example of a ribbon-like plate heat pipe having an excellent flexibility. Referring to FIG. 11, the ribbon-like plate heat pipe 100 comprises a plurality of ribbon-like plate heat pipe units 1-a, 1-b, 1-c . . . 1-n connected parallel to each other. The ribbon-like plate heat pipe units are joined through welded or soldered points 11 with a predetermined pitch obtained by point welding or soldering. Thus, the ribbon-like plate heat pipe 100 is shaped like a reed screen in its entirety. The continuous serpentine capillary tunnel containers of the ribbon-like plate heat pipe units 1-a, 1-b, 1-c . . . 1-n are connected to each other by the connecting means in the form of the capillary connecting tubes 7-1, 7-2 . . . 7-n in the similar way as described in connection with the third embodiment. The continuous serpentine capillary tunnel containers have at least 20 or more turns in their entirety.

The plate heat pipe for use of heat transport is often required to be flexible. For meeting such requirement, it is recommended to apply a ribbon-like plate heat pipe comprising narrow ribbon-like plate heat pipe units 1-a, 1-b, 1-c . . . 1-n connected like a reed screen and having less capillary parallel tunnels. With this ribbon-like plate heat pipe, the ribbon-like plate heat pipe units give an excellent flexibility in the three dimensional direction, enabling installation with excellent heat conduction even if an object to be heat exchanged is irregularly arranged in the three dimensional direction. Moreover, due to its excellent flexibility, the ribbon-like plate heat pipe according to the fifth embodiment can be arranged through clearances between parts disposed complicatedly in a device, transporting heat to a desired position.

Although each ribbon-like plate heat pipe unit has lowered performance due to less turns of the continuous serpentine capillary tunnel container, the continuous serpentine capillary tunnel containers of all ribbon-like plate heat pipe units 1-a, 1-b, 1-c . . . 1-n are connected to each other by the connecting means in the form of the capillary connecting tubes 7-1, 7-2 . . . 7-n, and they can thus have at least 20 or more turns in their entirety, obtaining excellent performance and less holding position dependency thereof.

Figure 12:
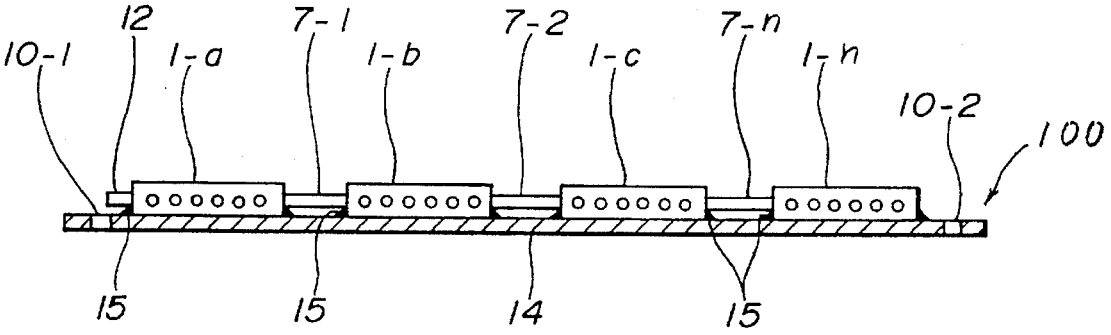
FIG. 12 is a side view, partly section, showing a sixth preferred embodiment of the present invention.

Referring to FIG. 12, a sixth embodiment of the present invention will be described. The sixth embodiment shows another example of a ribbon-like plate heat pipe having an excellent flexibility. Referring to FIG. 12, the ribbon-like plate heat pipe 100 comprises a plurality of ribbon-like plate heat pipe units 1-a, 1-b, 1-c . . . 1-n disposed parallel to each other at predetermined intervals. The ribbon-like plate heat pipe units are joined by welding or soldering on a surface of a thin and flexible metallic plate 14 with an area larger than that one defined by the ribbon-like plate heat pipe units, having enlarged contact area with an object to be heat exchanged. The above intervals are so large that fillets 15 of adjacent ribbon-like plate heat pipe units produced upon welding or soldering cannot be joined to each other, failing to deteriorate the flexibility of the metallic plate 14. The ribbon-like plate heat pipe mounting means in the form of the holes 10-1, 10-2 are arranged to the metallic plate 14 in a predetermined position thereof other than a position for the ribbon-like plate heat pipe unit.

Generally, the ribbon-like plate heat pipe according to the sixth embodiment is less excellent in flexibility than that one according to the fifth embodiment, while it gives more excellent flexibility in the direction perpendicular to the axial direction of the ribbon-like plate heat pipe. Moreover, the ribbon-like plate heat pipe according to the sixth embodiment is more excellent in surface smoothness than that one according to the fifth embodiment. An improvement of the surface smoothness, which plays an important part for heat conduction, is one of objects of the sixth embodiment. Due to extrusion molding, the ribbon-like plate heat pipe units have a greater forming error in thickness and width. Moreover, as being made of a soft metal, the ribbon-like plate heat pipe units 1-a, 1-b, 1-c . . . 1-n are excellent in flexibility, while they are apt to be bent or dented in the measuring & cutting process, the end face machining process, and the other secondary machining processes. Thus, a wide ribbon-like plate heat pipe obtained by joining the ribbon-like plate heat pipe units is often unsuitable for the usage which requires a severe surface smoothness. The structure of the sixth embodiment having the ribbon-like plate heat pipe units disposed and joined on a surface of the metallic plate is effective in such circumstances.

With the ribbon-like plate heat pipe according to the sixth embodiment also, each ribbon-like plate heat pipe unit cannot give a high performance due to less turns of the continuous serpentine capillary tunnel container. Therefore, the continuous serpentine capillary tunnel containers of all ribbon-like plate heat pipe units 1-a, 1-b, 1-c . . . 1-n are connected to each other by the connecting means in the form of the capillary connecting tubes 7-1, 7-2 . . . 7-n, and they can thus have at least 20 or more turns in their entirety, obtaining excellent performance and less holding position dependency thereof. When the continuous serpentine capillary tunnel container of each ribbon-like plate heat pipe unit has 20 or more turns, the connecting means may be eliminated.

The ribbon-like plate heat pipe according to the sixth embodiment is not flexible with respect to a three dimensional curved surface as that one according to the fifth embodiment, while it gives more excellent flexibility with respect to a two dimensional curved surface, enabling more effective heat transport.

Figure 13:
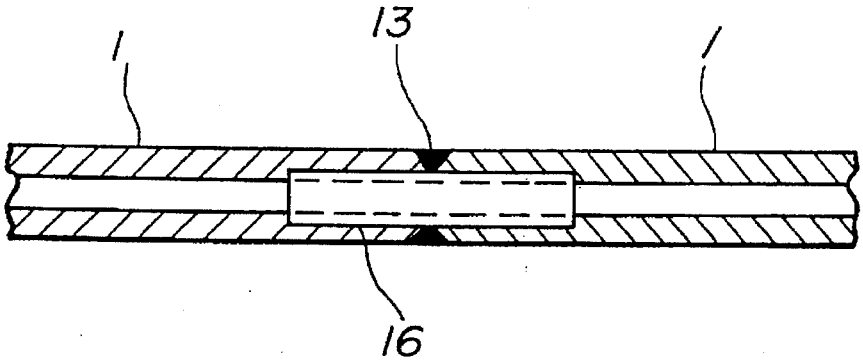
FIG. 13 is a fragmentary longitudinal section showing a seventh preferred embodiment of the present invention.

Referring to FIG. 13, a seventh embodiment of the present invention will be described. When a long ribbon-like plate heat pipe is manufactured by connecting the metallic ribbon-like plates 1 through welding or soldering, the capillary parallel tunnels 2-1, 2-2, 2-3 . . . 2-n of the ribbon-like plates 1 are apt to be closed by a melt metal due to their too small diameter. The seventh embodiment is conceived to ensure such welding or soldering with ease and without any trouble. Referring to FIG. 13, a capillary connecting tube 16 is interposed between the metallic ribbon-like plates 1, having each end inserted in the capillary parallel tunnel of the corresponding ribbon-like plate 1. The connecting tube 16 is short and thin, and is made of a metallic material having a higher fusing point than that of the ribbon-like plates 1 and no possible electric erosion therewith. In that state, the ribbon-like plates 1 are welded or soldered for connection. Reference numeral 13 designates a welded or soldered point of the ribbon-like plates 1. Since the connecting tube 16 is not melt at the fusing point of the metallic material of the ribbon-like plates 1, the capillary parallel tunnels may not be closed by influx of a melt metal on condition that the connecting tube 16 is engaged therewith closely. For improving the reliability of connection, the connecting tube 16 is coated with the same metallic material as that of the ribbon-like plates 1. With such coating, the connecting tube 16 as inserted in the ribbon-like plates 1 is welded or soldered thereto, result in largely improved reliability of connection. Thus, according to the seventh embodiment, a long ribbon-like plate heat pipe can be manufactured having several tens meters, or several hundred meters if necessary.

Figure 14:
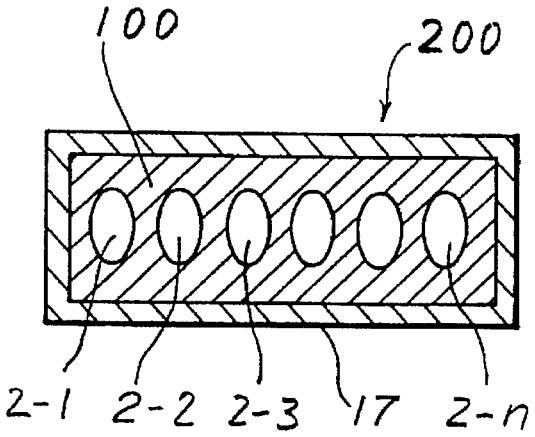
FIG. 14 is a view similar to FIG. 7, showing an eighth preferred embodiment of the present invention.
Figure 15:
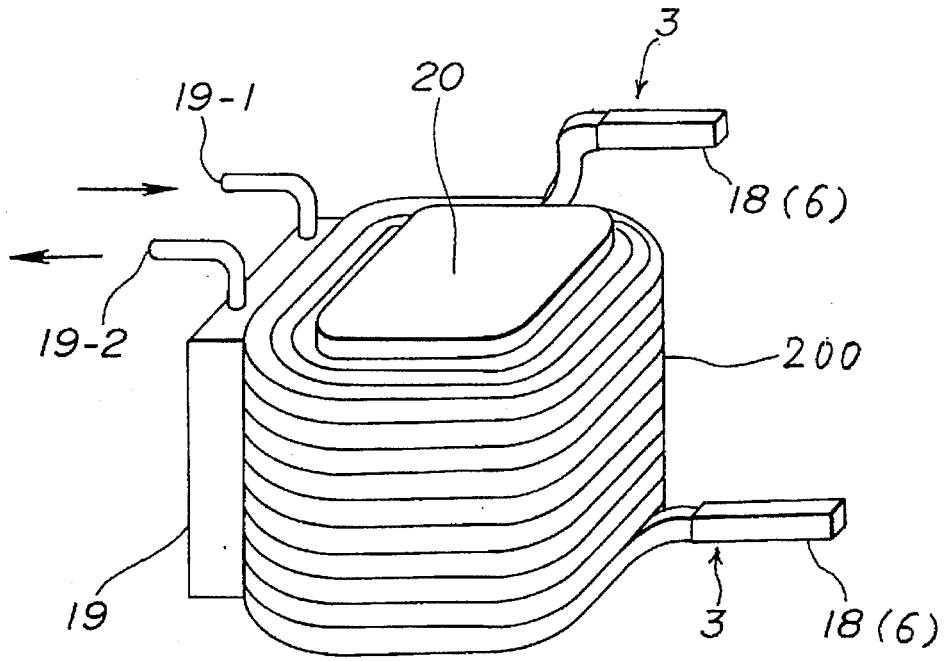
FIG. 15 is a view similar to FIG. 10, showing an electromagnetic equipment to which the eighth and ninth preferred embodiments are applied.

Referring to FIGS. 14 and 15, an eighth embodiment of the present invention will be described. The eighth embodiment shows an application of the ribbon-plate heat pipe to a coil for an electromagnetic equipment. As described above, the ribbon-like plate heat pipe 100 can be made with great length, so that, in the same way as the heat pipes as disclosed in U.S. Pat. No. 4,921,041 and U.S. Pat. No. 5,219,020, it serves as a self-cooling coil 200 for an electromagnetic equipment wherein self-produced Joule heat is transported to a heat radiation portion for self-cooling.

Referring to FIG. 14, the coil 200 comprises the ribbon-like plate heat pipe 100 having a continuous serpentine capillary tunnel container formed by capillary parallel tunnels 2-1, 2-2, 2-3 . . . 2-n, and a heat-resistant insulating coating 17. Referring to FIG. 15, the electromagnetic equipment is constructed such that the coil 200 comprising the ribbon-like plate heat pipe 100 is wound around an iron core 20, and a cooling jacket 19 as heat radiating means is disposed in contact with the coil 200 as wound, cooling water being taken therein through an inlet 19-1, and discharged therefrom through an outlet 19-2. As being made of a light and soft metallic material, the ribbon-like plate heat pipe 100 is excellent in flexibility, so that the coil 200 resulting therefrom ensures not only a good working efficiency upon winding operation, but a weight reduction of the electromagnetic equipment.

When serving as a coil for an electromagnetic equipment, the known serpentine capillary heat pipe having only one tunnel container cannot be active by itself, failing to give a self-cooling characteristic. Thus, the cooling means 19 is indispensable so that the heat pipe provides a plurality of heat receiving and radiating portions to obtain mutual amplification of pressure waves due to nuclear boiling produced in the heat receiving portions. On the other hand, the ribbon-like plate heat pipe 100 of the present invention is formed essentially with a continuous serpentine capillary tunnel container having a plurality of turns, and it can be thus used as a coil for an electromagnetic equipment without cooling means 19. With the cooling means 19, the coil 200 comprising the ribbon-like plate heat pipe 100 gives a further higher performance than that one comprising the known serpentine capillary heat pipe. For obtaining a greater effect, it is preferable to apply a wide ribbon-like plate heat pipe having a plurality of capillary parallel tunnels 2-1, 2-2, 2-3 . . . 2-n, i.e. a plurality of turns.

Moreover, the coil 200 comprising the ribbon-like plate heat pipe 100 can be manufactured with decreased thickness, producing a further greater effect than with that one comprising the known serpentine capillary heat pipe, of which a decrease in thickness is not possible due to a larger inner diameter of its single tunnel container. A first advantage of a decrease in thickness of the coil is a possible compensation of a decreased number of winds due to an increased width of the coil, by which an equivalent number of winds can be kept. A second advantage is an improvement of heat absorption and radiation effect or self-cooling function due to increased heat receiving and radiating areas. Specifically, the coil 200 is improved in heat exchanging performance between layers of the coil due to an enlarged contact area thereof, and in heat radiating performance due to an enlarged heat exchanging area with respect to the cooling means 19.

Referring always to FIG. 15, a ninth embodiment of the present invention will be described. The ninth embodiment shows an application of the ribbon-like plate heat pipe to a lead wire for an electromagnetic equipment. Referring to FIG. 15, the electromagnetic equipment includes lead wires 18 connected to ends of the coil 200 comprising the ribbon-like plate heat pipe 100 with both ends closed by the closing means 3. As described above in connection with FIG. 5, the closing means 3 comprises the metallic ribbon-like plate 6 with no capillary parallel tunnels or a small piece thereof butted and welded to the ribbon-like plate 1. According to the ninth embodiment, the ribbon-like plate 6 with no capillary parallel tunnels serves as the lead wire 18. In a coil for an electromagnetic equipment, its end portion undergoes the greatest external force, particularly, the base of the lead wire 18 on the coil side. After winding, the coil 200 is tightened to apply a force to the base of the lead wire 18, which is further subjected to repeated bending, and connected finally to power supplying means. It will be thus understood that the base of the lead wire 18 should be constructed most robustly in the coil. The end portion of the ribbon-like plate heat pipe 100 of the present invention has a block-like structure obtained by solidification of a melt metal penetrating upon welding operation into the capillary parallel tunnels up to a predetermined depth, which has a greater tensile strength than the other portions of the ribbon-like plate heat pipe 100, and therefore, meets the requirement of strength of the lead wire 18.

Figure 16:
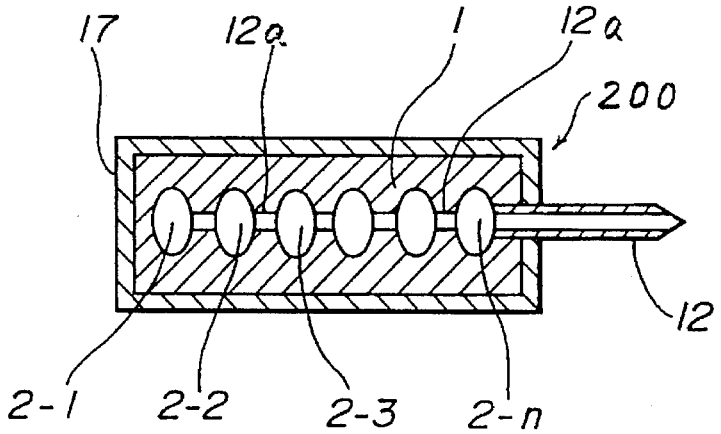
FIG. 16 is a view similar to FIG. 14, showing a tenth preferred embodiment of the present invention.

Referring to FIG. 16, a tenth embodiment of the present invention will be described. The tenth embodiment is conceived to make easy a charging operation of the ribbon-like plate heat pipe with working fluid when it serves, e.g. as a coil for an electromagnetic equipment. Referring to FIG. 15, if the coil 200 has 20 or more winds, the ribbon-like plate heat pipe 100 may not be formed with a continuously serpentine capillary tunnel container. The number of winds of the coil corresponds to that of turns of the continuous serpentine capillary tunnel container, so that, with 20 or more winds of the coil 200, the capillary parallel tunnel of the ribbon-like plate heat pipe 100 can fully perform its function. That is, the ribbon-like plate 1 having both end closed can be used without alternately eliminating the partitions 1-1 by a predetermined length in the vicinity of the ends of the ribbon-like plate 1.

Referring to FIG. 16, according to the tenth embodiment, for charging each capillary parallel tunnel 2-1, 2-2, 2-3 . . . 2-n with working fluid, a connecting tunnel 12*a* of very small diameter is arranged to ensure communication of the capillary parallel tunnel 2-1, 2-2, 2-3 . . . 2-n with each other. The connecting tunnel 12*a* is formed through the longitudinal edge wall of the ribbon-like plate 1, and the partitions 1-1. According to the tenth embodiment, the connecting tunnel 12*a* is arranged to correspond to the working fluid injecting tube 12, alternatively, it may be arranged so as not to correspond thereto. Due to its very small diameter, a formation of the connecting tunnel 12*a* cannot result in a reduction in mechanical strength of the ribbon-like plate 1. Thus, according to the tenth embodiment, the coil 200 comprising the ribbon-like plate heat pipe can be manufactured with reduced time and cost, and largely improved reliability.

Having described the present invention in connection with the preferred embodiment, it is noted that the present invention is not limited thereto, and various changes and variation can be made without departing form the spirit of the present invention.

What is claimed is:

1. A ribbon-like plate heat pipe, comprising:

a plate having a plurality of tunnels arranged parallel to each other and defined by a plurality of partitions;

means for closing ends of said plate, said ends closing means being disposed up to a predetermined depth of said plurality of tunnels from each end of said plate; and means for ensuring communication of said plurality of tunnels with each other to form a serpentine container having a predetermined turns, said serpentine container being filled with a predetermined amount of a predetermined working fluid.

2. A ribbon-like plate heat pipe as claimed in claim 1, wherein said plate is made of a metallic material having a fusing point lower than that of a pure copper.

3. A ribbon-like plate heat pipe as claimed in claim 1, wherein said ends closing means are obtained by face-fed welding, squeezing & welding, and butt welding.

4. A ribbon-like plate heat pipe as claimed in claim 1, wherein said communication ensuring means comprise said plurality of partitions eliminated alternately by a predetermined length in a vicinity of said ends of said plate.

5. A ribbon-like plate heat pipe as claimed in claim 4, wherein said communicating ensuring means are obtained by:

forming a groove in a surface of said plate in a position at a predetermined distance away from a corresponding end, said groove being substantially parallel to said corresponding end of said plate, said groove having a depth failing to reach a film disposed on a top wall of said plurality of tunnels, said groove having a width greater than said predetermined length of said plurality of partitions;

making a hole up to a bottom wall of said plurality of tunnels;

fitting a tape with corresponding width and thickness into said groove; and joining said tape to said plate.

6. A ribbon-like plate heat pipe as claimed in claim 5, wherein said film is thin enough to enable confirmation of a position of said plurality of partitions.

7. A ribbon-like plate heat pipe as claimed in claim 1, further comprising:

a tube arranged to charge said serpentine container with said predetermined amount of said predetermined working fluid.

8. A ribbon-like plate heat pipe as claimed in claim 7, further comprising:

a tube arranged to connect ends of said serpentine container.

9. A ribbon-like plate heat pipe as claimed in claim 8, wherein said tube is coated with said metallic material of said plate.

10. A ribbon-like plate heat pipe as claimed in claim 1, wherein said predetermined turns of said serpentine container correspond to at least 20.

11. A ribbon-like plate heat pipe equipment, comprising:

a plurality of ribbon-like plate heat pipes disposed parallel to each other, each comprising a plate having a plurality of tunnels arranged parallel to each other and defined by a plurality of partitions; means for closing ends of said plate, said ends closing means being disposed up to a predetermined depth of said plurality of tunnels from each end of said plate; and means for ensuring communication of said plurality of tunnels with each other to form a serpentine container having a predetermined turns, said serpentine container being filled with a predetermined amount of a predetermined working fluid; and means for connecting said plurality of ribbon-like plate heat pipes to each other.

12. A ribbon-like plate heat pipe equipment as claimed in claim 11, wherein said predetermined turns of said serpentine container corresponds to at least 20.

13. A ribbon-like plate heat pipe equipment as claimed in claim 11, further comprising:

means for ensuring communication of said serpentine container of one of said plurality of ribbon-like plate heat pipes with that of an adjacent one thereof, said communication ensuring means enabling formation of a continuous serpentine container having a predetermined turns through said plurality of ribbon-like plate heat pipes.

14. A ribbon-like plate heat pipe equipment as claimed in claim 13, wherein said predetermined turns of said continuous serpentine container correspond to at least 20 turns.

15. A ribbon-like plate heat pipe equipment as claimed in claim 13, further comprising:

a plurality of plates arranged parallel to said plurality of ribbon-like plate heat pipes, said plurality of plates and said plurality of ribbon-like plate heat pipes being disposed alternately.

16. A ribbon-like plate heat pipe equipment as claimed in claim 15, wherein said plurality of plates comprise means for mounting said plurality of ribbon-like plate heat pipes.

17. A ribbon-like plate heat pipe equipment as claimed in claim 11, wherein said plates connecting means are obtained by point welding and point soldering.

18. A ribbon-like plate heat pipe equipment, comprising:

a flat plate;

a plurality of ribbon-like plate heat pipes disposed on said flat plate at predetermined intervals to be parallel to each other, each comprising a plate having a plurality of tunnels arranged parallel to each other and defined by a plurality of partitions; means for closing ends of said plate, said ends closing means being disposed up to a predetermined depth of said plurality of tunnels from each end of said plate; and means for ensuring communication of said plurality of tunnels with each other to form a serpentine container having a predetermined turns, said serpentine container being filled with a predetermined amount of a predetermined working fluid; and means for ensuring communication of said serpentine container of one of said plurality of ribbon-like plate heat pipes with that of an adjacent one thereof, said communication ensuring means enabling formation of a continuous serpentine container having a predetermined turns through said plurality of ribbon-like plate heat pipes.

19. A ribbon-like plate heat pipe equipment as claimed 18, wherein said predetermined turns of said continuous serpentine container corresponds to at least 20.

20. A ribbon-like plate heat pipe equipment as claimed 18, wherein said flat plate comprises means for mounting said plurality of ribbon-like plate heat pipes.

21. A ribbon-like plate heat pipe equipment, comprising:

a plurality of plates disposed in series to form a plate assembly, each having a plurality of tunnels arranged parallel to each other and defined by a plurality of partitions;

means for connecting said plurality of tunnels of one of said plurality of plates and those of an adjacent one thereof;

means for closing ends of said plate assembly, said ends closing means being disposed up to a predetermined depth of said plurality of tunnels from each end of said plate assembly.

22. A ribbon-like plate heat pipe equipment as claimed in claim 21, wherein said tunnels connecting means comprise a tube made of a metallic material which has a fusion point higher than that of a metallic material of said plurality of plates, and no possible electric erosion therewith.

23. A ribbon-like plate heat pipe equipment as claimed in claim 22, wherein said tube is coated with said metallic material of said plurality of plates.

24. A ribbon-like plate heat pipe equipment as claimed in claim 21, further comprising:

a heat-resistant insulating coating disposed on said plurality of plates.

25. A ribbon-like plate heat pipe equipment as claimed in claim 24, further comprising:

means for connecting said plurality of tunnels of each of said plurality of plates to each other.

26. A ribbon-like plate heat pipe equipment as claimed in claim 25, wherein said tunnels connecting means are in a form of a tunnel formed through said plurality of partitions of one of said plurality of plates.

* * * * *